United States Patent [19]

Adams

[11] 3,960,356

[45] June 1, 1976

[54] ANCHOR BOLT HOLDER

[76] Inventor: John H. Adams, 1801 21st Ave., Kingsburg, Calif. 93631

[22] Filed: Oct. 24, 1974

[21] Appl. No.: 517,586

[52] U.S. Cl. ..... 249/205; 24/260; 249/93

[51] Int. Cl.[2] ..... B28B 23/00

[58] Field of Search ..... 249/91, 93, 207, 210, 249/205; 269/43, 157; 24/260, 255 C, 257 R, 137 R, 137 A, 138 R, 138 A; 264/278, 35

[56] References Cited

UNITED STATES PATENTS

| | | | |
|---|---|---|---|
| 763,793 | 6/1904 | Pickert | 24/260 |
| 1,784,329 | 12/1930 | Bierhaalder | 249/91 |
| 2,074,500 | 3/1937 | York | 249/92 |
| 2,562,751 | 7/1951 | Tegarty | 24/137 R |
| 3,100,324 | 8/1963 | Tutino et al. | 24/260 |
| 3,197,171 | 7/1965 | Michalak | 249/91 |

FOREIGN PATENTS OR APPLICATIONS

| | | | |
|---|---|---|---|
| 433,827 | 1/1912 | France | 24/138 R |

*Primary Examiner*—Francis S. Husar
*Assistant Examiner*—John McQuade
*Attorney, Agent, or Firm*—Roger B. Webster

[57] ABSTRACT

A holder adapted to support an anchor bolt in a position for partial embedding in concrete poured into a form to which the holder is pre-secured; the holder comprising a generally fork-shaped body having elongated, side-by-side legs connected together at one end in spring relation, and means securing the legs of the body to a form to overhang the concrete with the anchor bolt frictionally gripped between such legs; the legs being formed, on adjacent sides, with registering notches in which the anchor bolt is engaged.

3 Claims, 4 Drawing Figures

ANCHOR BOLT HOLDER

BACKGROUND OF THE INVENTION

With conventional form-mounted anchor bolt supporting devices, they are frequently difficult and time-consuming to install with the anchor bolts in proper position, and are not always wholly effective in that at times the anchor bolt is permitted to drift, undesirably, from the initial positional setting during pouring and vibrating of the concrete. The present invention was conceived in a successful effort to over come such problems.

SUMMARY OF THE INVENTION

The present invention provides, as an important object, an anchor bolt holder which is simple in form and readily and easily manually installed, with the anchor bolt firmly frictionally gripped and supported in proper position; the body of the holder being one-piece, preferably of a durable plastic, and re-usable.

The present invention provides, as another important object, a holder adapted to support an anchor bolt in a position for partial embedding in concrete poured into a form to which the holder is pre-secured; the holder comprising a generally fork-shaped body having elongated, side-by-side legs connected together at one end in spring relation, and means securing the legs of the body to the form to overhang the concrete with the anchor bolt frictionally gripped between such legs; the legs being formed, on adjacent sides, with registering notches in which the anchor bolt is engaged.

The present invention provides, as a further object, an anchor bolt holder which is designed for ease and economy of manufacture.

The present invention provides, as a still further object, a practical, reliable, and durable anchor bolt holder, and one which is exceedingly effective for the purpose for which it is designed.

DESCRIPTION OF THE PREFERRED EMBODIMENT

Referring now more particularly to the drawings and to the characters of reference marked thereon, the anchor bolt holder of the present invention comprises a one-piece elongated body, indicated generally at 1, preferably of a heavy-duty plastic such as polyethylene.

Figure 3:
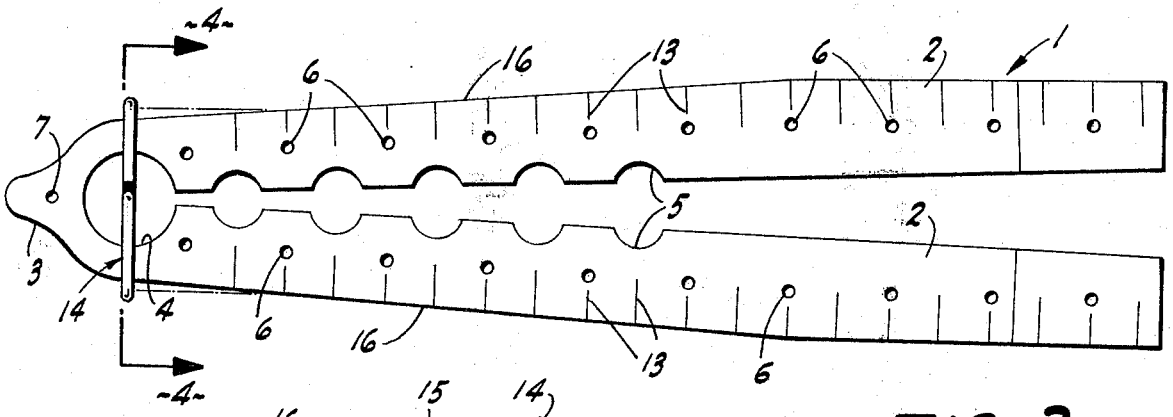
FIG. 3 is an enlarged view of the anchor bolt holder, detached.
Figure 4:
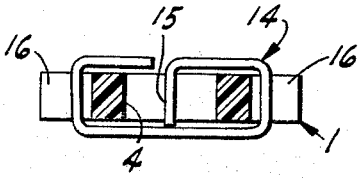
FIG. 4 is a cross section on line 4-4 of FIG. 3.

The body 1—which is essentially fork-shaped—is comprised of a pair of side-by-side elongated legs 2; such legs being connected together at one end by an integral head 3. A relatively large, symmetrically disposed, circular opening 4, through the holder at the juncture of the legs 2 and the head 3, imparts to said head a generally C form which, in effect, provides, due to the slight bendability and resiliency of the plastic—a spring hinge. In short, the legs 2—which initially slightly diverge in a direction away from the head 3 (see FIG. 3)—are in spring relation and can be manually sprung toward each other, and into substantial parallelism, for the purpose to be later described.

Intermediate the ends thereof, the legs 2 are each formed, in the inner or adjacent longitudinal edges thereof, with a row of half-circle notches 5, with the corresponding notches in register; the notches 5 being equally spaced lengthwise of the legs 2.

Each leg 2, between its inner and outer longitudinal edges, is provided with a row of equally spaced nail-receiving holes 6 extending therethrough from one face to the other; such holes being positioned laterally outwardly of, and spaced half the distance between, adjacent notches 5.

The head 3, at its outer end portion, has a nail-receiving hole 7 therethrough from face to face; such hole 7 being in the central longitudinal vertical plane of the body 1.

In one manner of use of the described holder, an anchor bolt 8 is disposed—intermediate its ends—between the legs 2 in alinement with selected registering notches 5, and said legs 2 are then forcefully manually sprung substantially together in order to firmly and positively frictionally grip or clamp the anchor bolt in retention in such notches; the legs sometimes then resiliently bowing to a slight extent which aids in such gripping of the anchor bolt. With the legs 2 thus sprung together, the body 1 is spanned between spaced form boards 9 and 10 of a pre-erected concrete receiving form, and a nail 11 is driven through the hole 7, in head 3, into form board 9, while nails 12 are driven through the related holes 6, in legs 2, into form board 10. As so secured in spanning relation to the form boards 9 and 10 (while also serving as a cleat), the holder effectively supports the anchor bolt in a pre-selected position depending in part for embedding in the concrete to be poured into the form between said form boards 9 and 10.

In order to aid in the selection of the proper registering notches 5 for reception of the anchor bolt 8, and dependent upon the spacing of form boards 9 and 10, the legs 2 are marked or scribed, as at 13, in increments of measure.

The nails 11 and 12 are preferably of double-headed type whereby to permit of ready pulling of such nails—with a claw hammer or claw bar—for removal of the body 1 of the holder for re-use.

Figure 1:
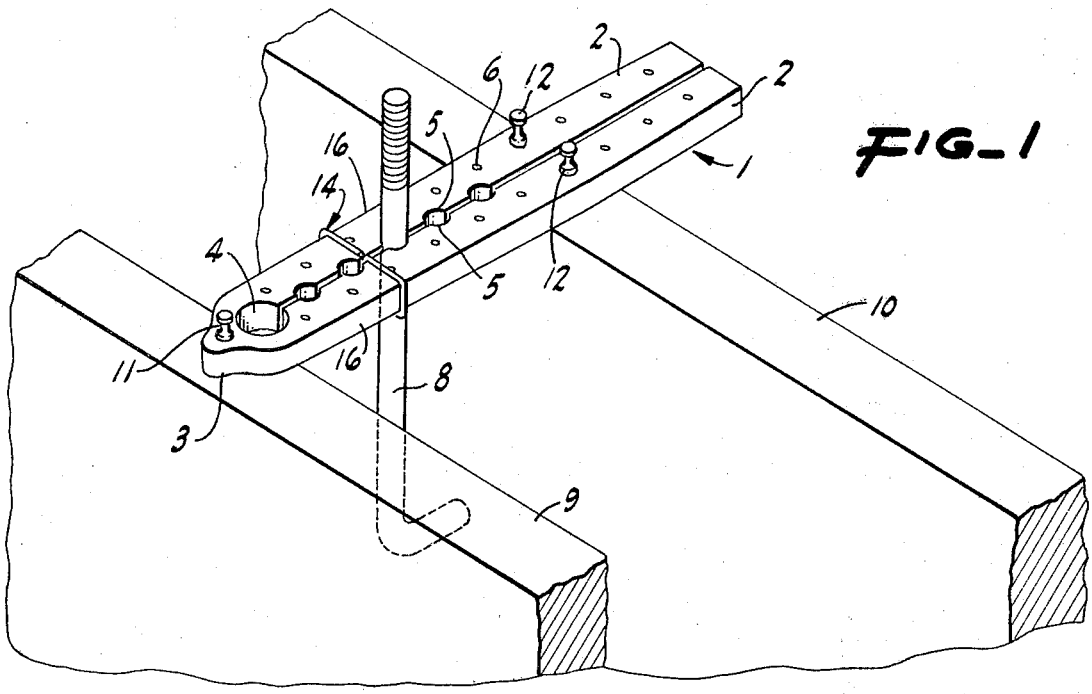
FIG. 1 is a perspective view of the anchor bolt holder as in use.
Figure 2:
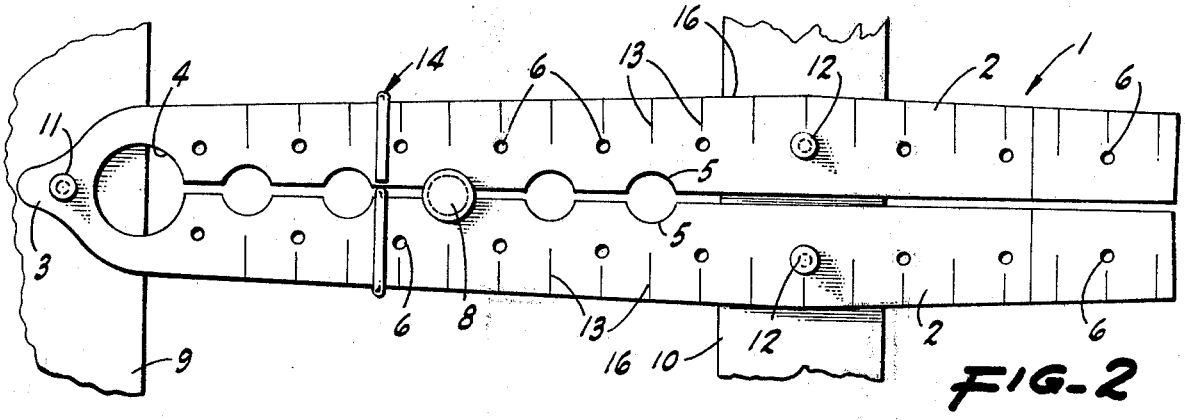
FIG. 2 is an enlarged plan view of the same.

A sliding collar 14 encompasses the body 1 transversely thereof; such collar, which is substantially rectangular, including a central cross finger 15 which prevents escape of said collar from the body at the head-end of the latter, and at which point such collar is initially disposed. The outer longitudinal edges 16 of the legs 2 diverge relative to each other—to form divergent cam surfaces—from the head 3 for substantially the length of the inner half of the body 1; this being the zone of the registering notches 5 in the inner longitudinal edges of said legs. After an anchor bolt 8 is frictionally gripped or clamped between the legs 2 by springing the latter toward each other, the grip on such bolt may—if desired or necessary—be increased by sliding the collar 14 along the body 1 toward such bolt 8; the ends of the collar then advancing, in contact, along the divergent cam surfaces 16 further urging the legs toward each other and imposing an additional clamping force on the anchor bolt (see FIG. 1).

While this specification makes reference to the holder being for the purpose of gripping and supporting an anchor bolt, such term shall be deemed to include all equivalent structural elements such as reinforcing bars, electric conduits, and the like.

From the foregoing description it will be readily seen that there has been produced such an anchor bolt holder as substantially fulfills the objects of the invention as set forth herein.

While this specification sets forth in detail the present and preferred construction of the anchor bolt holder, still in practice such deviations from such detail may be resorted to as do not form a departure from the spirit of the invention as defined by the appended claims.

I claim:

1. A holder for a structural element to be partially embedded in a fixed position in concrete during pouring of concrete in a pre-erected form comprising at least spaced-apart form boards; the holder comprising a generally fork-shaped body having a pair of elongated side-by-side legs dimensioned so as to span a space between spaced-apart form boards and adapted for the reception of a structural element therebetween, means connecting the legs at one end for movement of the legs toward each other whereby to clampingly engage and support a structural element therebetween, and means including at least a pre-formed hole in each of said legs for removably securing the legs of the body in fixed spanning relation to at least spaced-apart form boards with the legs maintained in clamping engagement with a structural element to be embedded whereby said securing means maintains said holder normally fixed against significant movement relative to at least spaced-apart form boards; said connecting means being a head integral with the legs; and said securing means comprising a form-penetrating nail extending through a pre-formed hole in the head and form-penetrating nails extending through pre-formed holes in the legs.

2. A holder for a structural element to be embedded in part in concrete poured in a pre-erected form and to which form the holder is adapted to be secured in use; the holder comprising a generally fork-shaped body having a pair of elongated side-by-side legs adapted for the reception of a structural element therebetween, means connecting the legs at one end for movement of the legs toward each other whereby to clampingly engage and support a structural element therebetween, and means for removably securing the body to such a form with the legs maintained in clamping engagement with a structural element, said securing means including form-penetrating nails, and the legs having pre-formed holes for reception of such nails.

3. A holder for a structural element to be partially embedded in a fixed position in concrete during pouring of concrete in a pre-erected form comprising at least one form board; the holder comprising a generally fork-shaped body having a pair of elongated side-by-side legs dimensioned so as to overlie a space adjacent a form board and adapted for the reception of a structural element therebetween, means connecting the legs at one end for movement of the legs toward each other whereby to clampingly engage and support a structural element therebetween, and means including at least a pre-formed nail-receiving hole in each of said legs for removably securing the legs of the body in fixed relation to at least a form board with the legs maintained in clamping engagement with a structural element to be embedded whereby said securing means maintains said holder normally fixed against significant movement relative to at least a form board; said connecting means being a head integral with the legs; and said securing means comprising a form board penetrating nail extending through a pre-formed hole in the head, and form board penetrating nails extending through said pre-formed holes in the legs.

* * * * *